US006032391A

United States Patent [19]

Yao

[11] Patent Number: 6,032,391

[45] Date of Patent: Mar. 7, 2000

[54] IRON AND STEAM BRUSH FOR BUSINESS USE

[75] Inventor: Isoji Yao, Higashi-Osaka, Japan

[73] Assignee: Naomoto Industry Co., Ltd., Osaka, Japan

[21] Appl. No.: 09/195,702

[22] Filed: Nov. 19, 1998

[30] Foreign Application Priority Data

Jul. 17, 1998 [JP] Japan ..... 10-202966

[51] Int. Cl.[7] ..... D06F 75/06

[52] U.S. Cl. ..... 38/77.6; 78/85; 68/222

[58] Field of Search ..... 38/77.6, 77.7, 38/77.9, 85; 219/254, 546, 548, 553; 261/DIG. 10, DIG. 32, DIG. 46, DIG. 76; 165/110, 117; 137/171; 68/222; 15/405

[56] References Cited

U.S. PATENT DOCUMENTS 1,593,896 7/1926 Brewer ..... 38/77.6
2,602,317 7/1952 Moss ..... 68/222 X
2,815,593 12/1957 Reimers et al. ..... 38/77.6
4,987,918 1/1991 Barnadas ..... 137/171
5,675,919 10/1997 Yao ..... 38/77.9
5,942,163 8/1999 Robinson et al. ..... 261/DIG. 76 X

*Primary Examiner*—Ismael Izaguirre
*Attorney, Agent, or Firm*—Armstrong, Westerman Hattori, McLeland & Naughton

[57] ABSTRACT

An iron having an iron main body and an electromagnetic valve which controls flow and stop of ironing steam. The iron is provided with a first tube for ironing steam, which sends ironing steam to the iron main body in open state of the electromagnetic valve, a second tube for heating steam, which sends heating steam to its end side along the first tube and heats approximately whole length of the first tube, and a third tube, which returns the steam from the end side of the second tube.

10 Claims, 7 Drawing Sheets

IRON AND STEAM BRUSH FOR BUSINESS USE

BACKGROUND OF THE INVENTION

1. Field of the Invention

This invention relates to an iron and a steam brush for business use.

2. Description of the Related Art

As a conventional iron and a conventional steam brush for business use, an iron and a steam brush constructed as that only a steam tube is connected to a main body (an iron main body or a steam brush main body), and steam is blown out of steam jets, which are formed on the main body, to clothes etc. by opening an electromagnetic valve arranged on an upstream side of the steam tube, are known.

However, in the conventional iron and the steam brush for business use as described above, while the electromagnetic valve is closed and the steam is not blown, temperature of the electromagnetic valve and the steam tube etc. decreases in a short period of time, and water droplets are generated. After then, when the electromagnetic valve is opened and the steam is blown, a problem that the water droplets come out with the steam and wet the clothes is caused. And, when the electromagnetic valve and the steam tube are cold, it takes time to become able to blow the steam out of the main body after switching on, and this causes a problem of low working efficiency.

It is therefore an object of the present invention, solving the problems above, to provide an iron for business use with which water drops are not blown out even if an iron main body is heated to be ordinary temperature, and steam blows immediately without time delay when a grip switch is switched on.

It is another object of the present invention to provide a steam brush for business use with which water drops are not blown out even if an steam brush main body is heated to be ordinary temperature, and steam blows immediately without time delay when a grip switch is switched on.

BRIEF DESCRIPTION OF THE DRAWINGS

The present invention will be described with reference to the accompanying drawings in which.

DESCRIPTION OF THE PREFERRED EMBODIMENTS

Preferred embodiments of the present invention will now be described with reference to the accompanying drawings.

Figure 1:
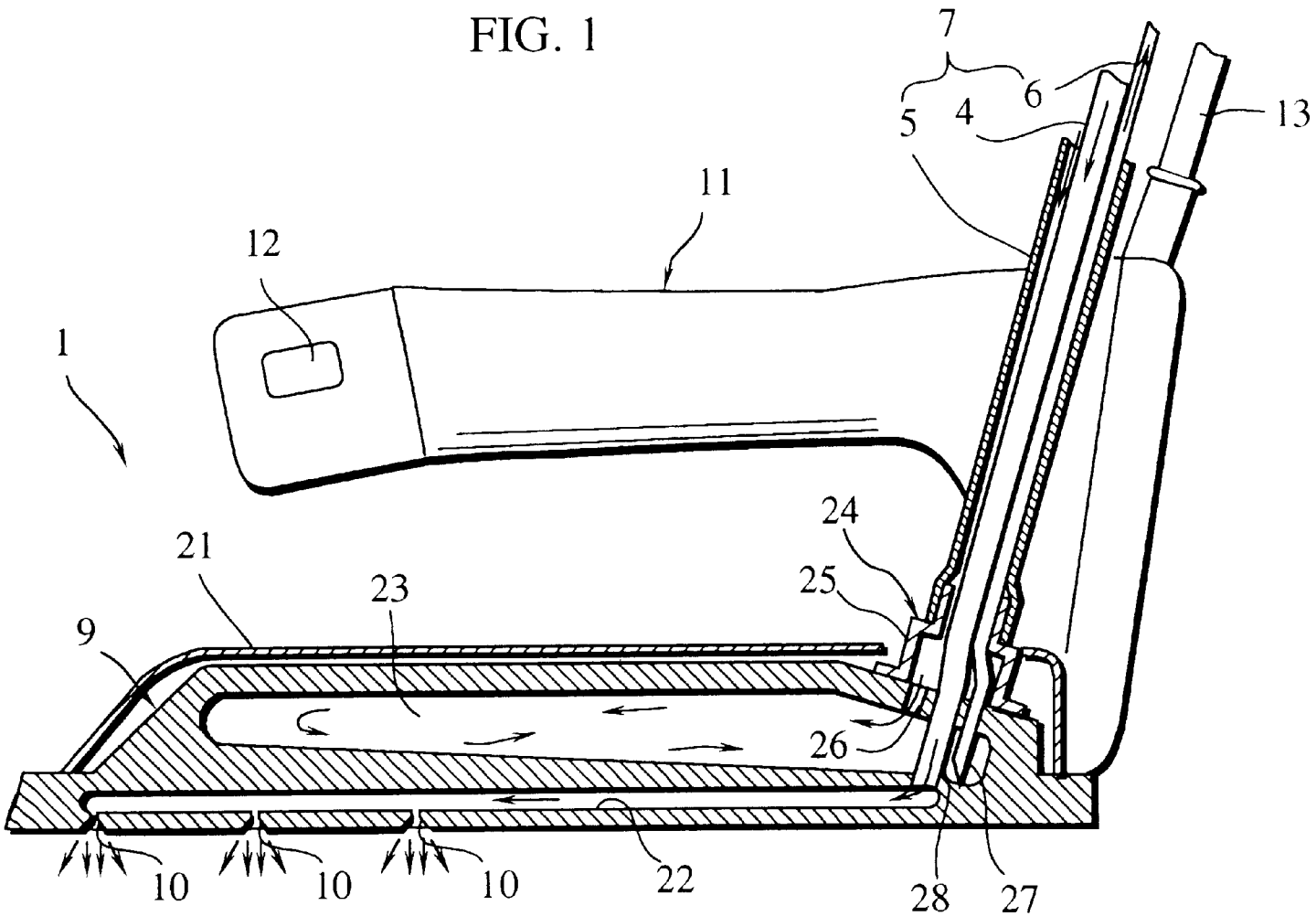
FIG. 1 is a schematic cross-sectional view showing a preferred embodiment of an iron of the present invention.
Figure 2:
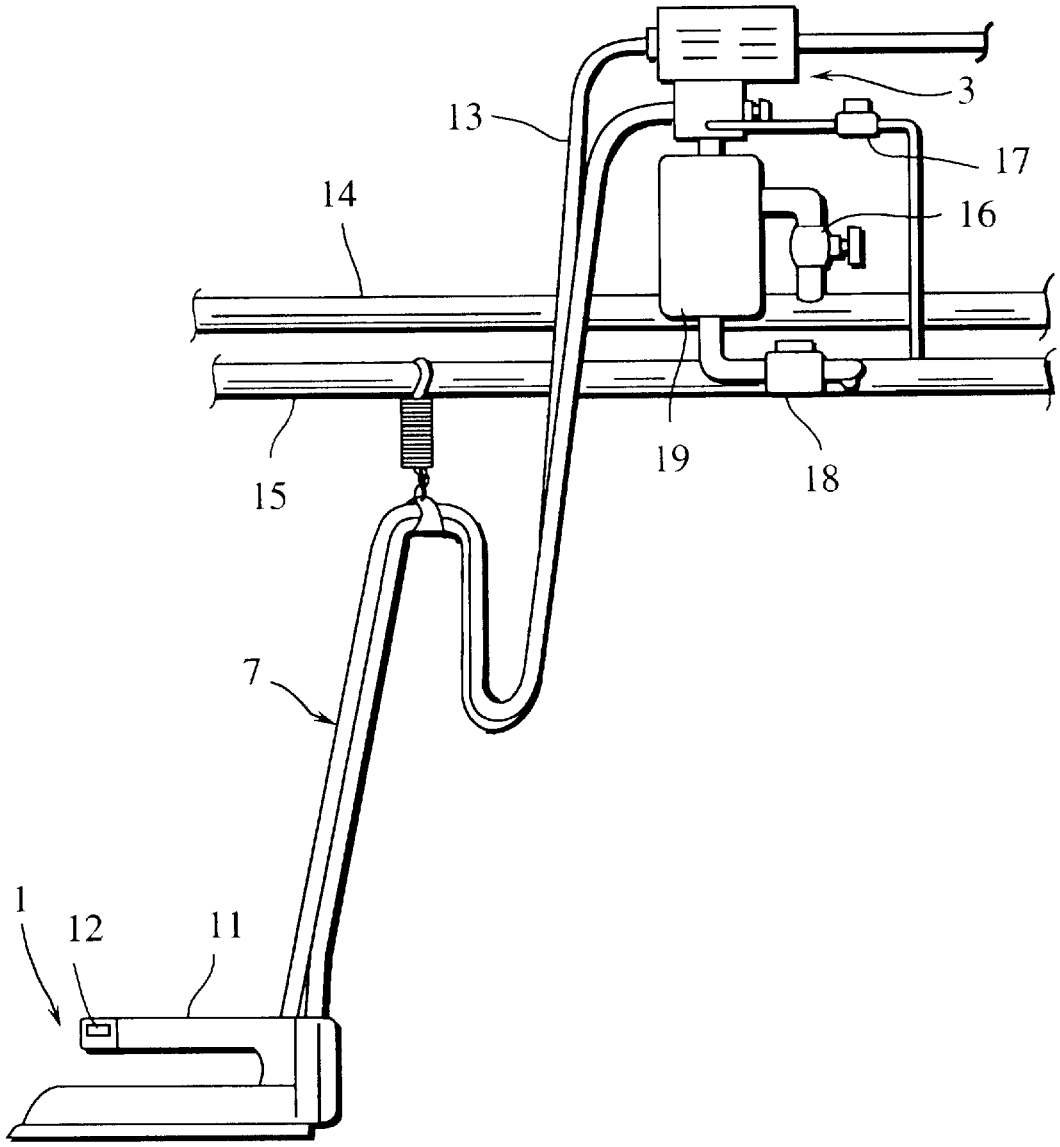
FIG. 2 is a view of whole construction showing the preferred embodiment of the iron of the present invention.

FIG. 1 and FIG. 2 show a preferred embodiment of an iron relating to the present invention. This iron has an iron main body 1 having plural steam jets 10 which blow ironing steam, an electromagnetic valve 3 which controls flow and stop of the ironing steam, a connection cord 13 which electrically connects the electromagnetic valve 3 to a grip switch 12 arranged on a grip portion 11 of the iron main body 1, and a flexible connection tube T which sends the ironing steam and heating steam to the iron main body 1.

And, in a working site, a fixed steam pipe 14 and a fixed drain pipe 15 connected to a steam generator such as a boiler (not shown in Figures) are arranged, and a base end side of the flexible connection tube 7 is communicatively connected to the steam pipe 14 and the drain pipe 15 through a steam valve 16, steam traps 17 and 18, a drain tank 19 (a separator), the electromagnetic valve 3, etc. The flexible connection tube 7 is hanged from ceiling etc. (from the drain pipe 15 in FIG. 2) with a expandable and contractible hanging member. The steam trap 17 may be a flowing amount regulation valve, and the drain tank 19 may be omitted.

Figure 3:
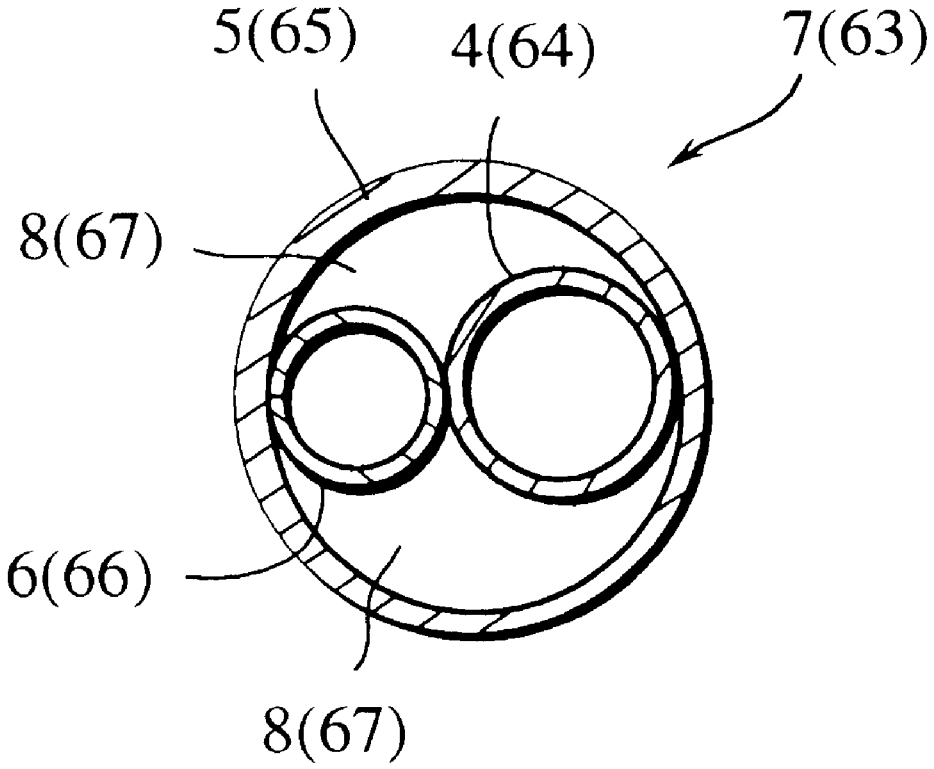
FIG. 3 is an enlarged cross-sectional view of a principal portion showing the preferred embodiment of the iron of the present invention.

The flexible connection tube 7, as shown in FIG. 1 and FIG. 3, is composed of a first tube 4 for ironing steam which sends the ironing steam to the iron main body 1, a second tube 5 for heating steam which sends the heating steam to its end side along the first tube 4 and heats approximately full length of the first tube 4, and a third tube (return tube) 6 which returns the steam from the end side of the second tube 5.

Concretely, the first tube 4 and the third tube 6 are inserted into the second tube 5, and this makes a triple tube structure. And, two gaps between an inner face of the second tube 5 and outer faces of the first tube 4 and the third tube 6 are heating steam passages 8.

And, as shown in FIG. 1, the iron main body 1 is provided with a heating body 9 of which lower face has the plural steam jets 10, a cover 21 attached to the heating body 9 with screws, etc., and the grip portion 11 of which end portion is provided with the grip switch 12. The heating body 9 has an ironing steam flow chamber 22, a heating steam chamber 23 which is formed separately from the steam flow chamber 22 and in which the steam for heating continuously flows, and inner end portions of the steam jets 10 are communicatively connected to the ironing steam flow chamber 22.

A rear portion of the heating body 9 is provided with a connecting portion 24 for connecting an end portion of the flexible connection tube 7. At the connecting portion 24, the second tube 5 and the third tube 6 are communicatively connected to the heating steam chamber 23, and, the first tube 4 is communicatively connected to the ironing steam flow chamber 22. That is to say, in the iron main body 1, the heating steam chamber 23, which is communicatively connected to the second tube 5 and the third tube 6, and in which the heating steam is continuously flowing, is formed.

The connecting portion 24 is fixed to a rear portion of an upper face of the heating body 9 and composed of a protruding joint portion 25 to which an end portion of the second tube 5 is connected, a through hole 26 which goes through an upper rear wall portion of the heating body 9 and communicatively connects an inner portion of the joint portion 25 to the heating steam chamber 23, a short pipe 27 for return steam which is inserted into the heating steam chamber 23 through the rear portion of the upper face of the heating body 9 and communicatively connects the third tube 6 to the heating steam chamber 23, and a short pipe 28 for steam which is inserted into the ironing steam flow chamber 22 through the rear portion of the upper face of the heating body 9 and communicatively connects the first tube 4 to the ironing steam flow chamber 22.

Figure 4:
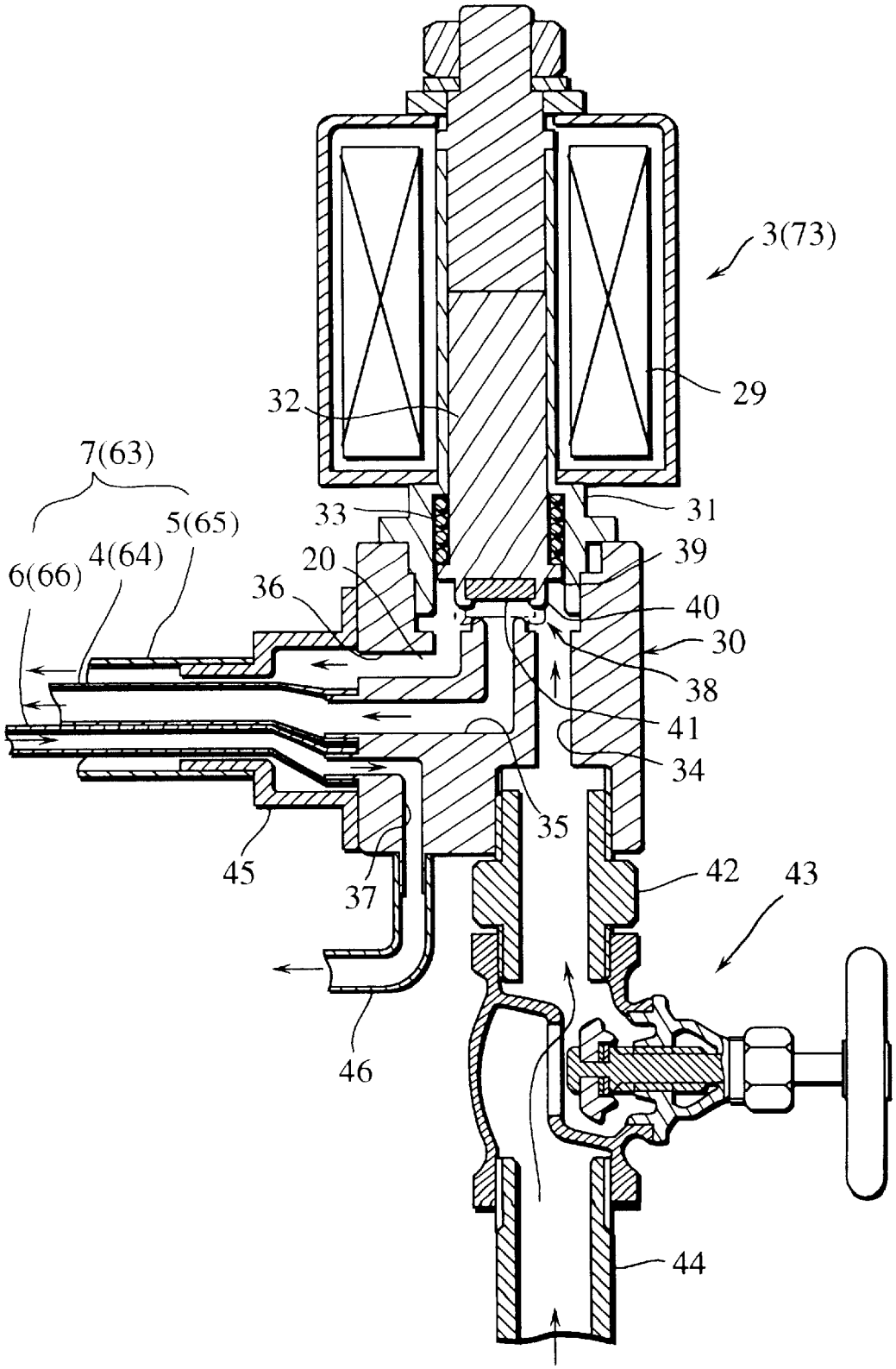
FIG. 4 is an enlarged cross-sectional view of a principal portion showing the preferred embodiment of the iron of the present invention.

Next, as shown in FIG. 4, the electromagnetic valve 3 is provided with a main body portion 30 in which plural passages described later in detail are formed inside, an upper cover 31 attached to the main body portion 30, a spool 32 inserted to the upper cover 31 as to freely slide up and down, a solenoid 29 attached to an outer face of the upper cover 31, and an elastic member 33 (a spring) arranged between the upper cover 31 and the spool 32 as to elastically push the spool 32 to an end side (below).

And, in the main body portion 30, a steam inflow passage 34, a first steam outflow passage 35 which outflows the ironing steam, a second steam outflow passage 36 which outflows the heating steam, and a return steam passage 37, are formed. And, a steam flow chamber 38 which communicates with the steam inflow passage 34, the first steam outflow passage 35, and the second steam outflow passage 36 in an open state, and communicates with only the steam inflow passage 34 and the second steam outflow passage 36 in a closed state, is formed.

The steam flow chamber 38 consists of a cavity surrounded by the main body portion 30, the upper cover 31, and the spool 32. Concretely, a circular lower end face portion 39 and a cylindrical portion 40 protruding below on inner side of the circular lower end face portion 39 are formed on a lower end of the spool 32, and a contact member 41, which can contact and part from an opening edge of an upstream side of the first steam outflow passage 35, is set inside the cylindrical portion 40.

Then, a heating steam flow passage 20, in which the heating steam to the second tube 5 continuously flows, is formed adjacent to the electromagnetic valve 3. The heating steam flow passage 20 consists of the steam inflow passage 34, the steam flow chamber 38, and the second steam outflow passage 36.

And, the steam inflow passage 34 is communicatively connected to a manual valve 43 (a steam stop valve) through a joint member 42. Further, the manual valve 43 is communicatively connected to a steam pipe (not shown in Figures) through a pipe 44. And, end portions of downstream sides of the first steam outflow passage 35 and the second steam outflow passage 36, and an end portion of an upstream side of the return steam passage 37, open on a side face of the main body portion 30, and, a cylindrical member 45 for connection is fixed on the side face of the main body portion 30 as to surround these openings.

And, the second steam outflow passage 36 is communicatively connected to the second tube 5 by connecting the second tube 5 of the flexible connection tube 7 to the cylindrical member 45 for connection, the first tube 4 is communicatively connected to the first steam outflow passage 35, and the third tube 6 is communicatively connected to the return steam passage 37. And, a downstream side of the return steam passage 37 is connected to the drain pipe through the drain tank and the steam traps outside of FIG. 4.

In an open state of the electromagnetic valve 3, the contact member 41 parts from an opening edge of a base end side of the first steam outflow passage 35 as the spool 32 ascends, and the steam flow chamber 38 communicates with the steam inflow passage 34, the first steam outflow passage 35, and the second steam outflow passage 36. And, in a closed state, the contact member 41 contacts the opening edge of the base end side of the first steam outflow passage 35 and closes the first steam outflow passage 35 as the spool 32 descends, and the steam flow chamber 38 communicates only with the steam inflow passage 34 and the second steam outflow passage 36.

Next, working condition of this iron for business use will be described with reference to FIG. 1 through FIG. 3. In a state that the grip switch 12 of the iron main body 1 is switched off and the electromagnetic valve 3 is closed, steam does not come out of the steam jets 10 on the iron main body 1 because the steam does not flow inside the first tube 4. In this state, heating steam flows from the second steam outflow passage 36 of the electromagnetic valve 3 to the second tube 5 (refer to FIG. 3), the heating steam flows into the heating steam chamber 23 of the iron main body 1, and the steam is sent back to the electromagnetic valve 3 side through the third tube 6 (refer to FIGS. 1 and 2).

Therefore, even if the grip switch 12 is off, namely, the iron is not under ironing, steam flows inside the electromagnetic valve 3 and the electromagnetic valve 3 is continuously heated, and the first tube 4 is continuously heated by the heating steam flows inside the second tube 5. Further, the heating body 9 of the iron main body 1 is continuously heated by the heating steam flows into the heating steam chamber 23.

Next, the grip switch 12 is switched on, the electromagnetic valve 3 opens, steam flows inside the first tube 4, and the steam goes through the ironing steam flow chamber 22 and blows out of the steam jets 10 to outside(clothes' side). In this case, as described above, the electromagnetic valve 3, the first tube 4, and the heating body 9 of the iron main body 1 are continuously heated, steam of preceding ironing operation fills the first steam outflow passage 35, the first tube 4, and the ironing steam flow chamber 22 before the opening of the electromagnetic valve 3 thereby, and the ironing steam immediately blows out of the steam jets 10 right after the switching-on. Moreover, water droplets do not come out of the steam jets 10.

Therefore, time lag between the switching-on and the steam blowout is very little, the ironing steam can be blown right after the grip switch 12 is on, and ironing operation can be conducted efficiently. And, blowing the water droplets out of the steam jets 10 can be prevented, clothes do not wet, and ironing operation can be conducted quickly and cleanly.

Figure 5:
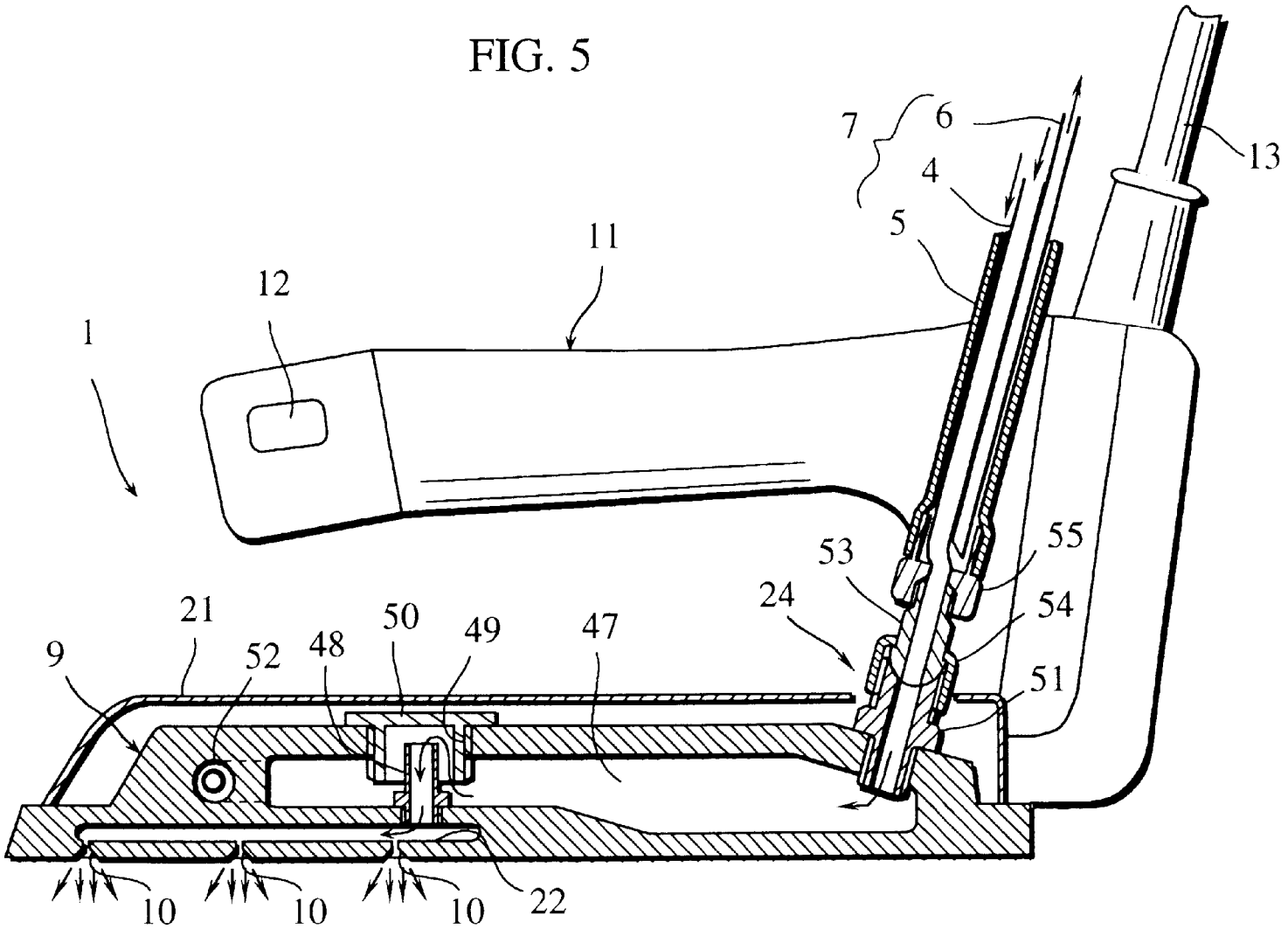
FIG. 5 is a schematic cross-sectional view showing another preferred embodiment of the present invention.
Figure 6:
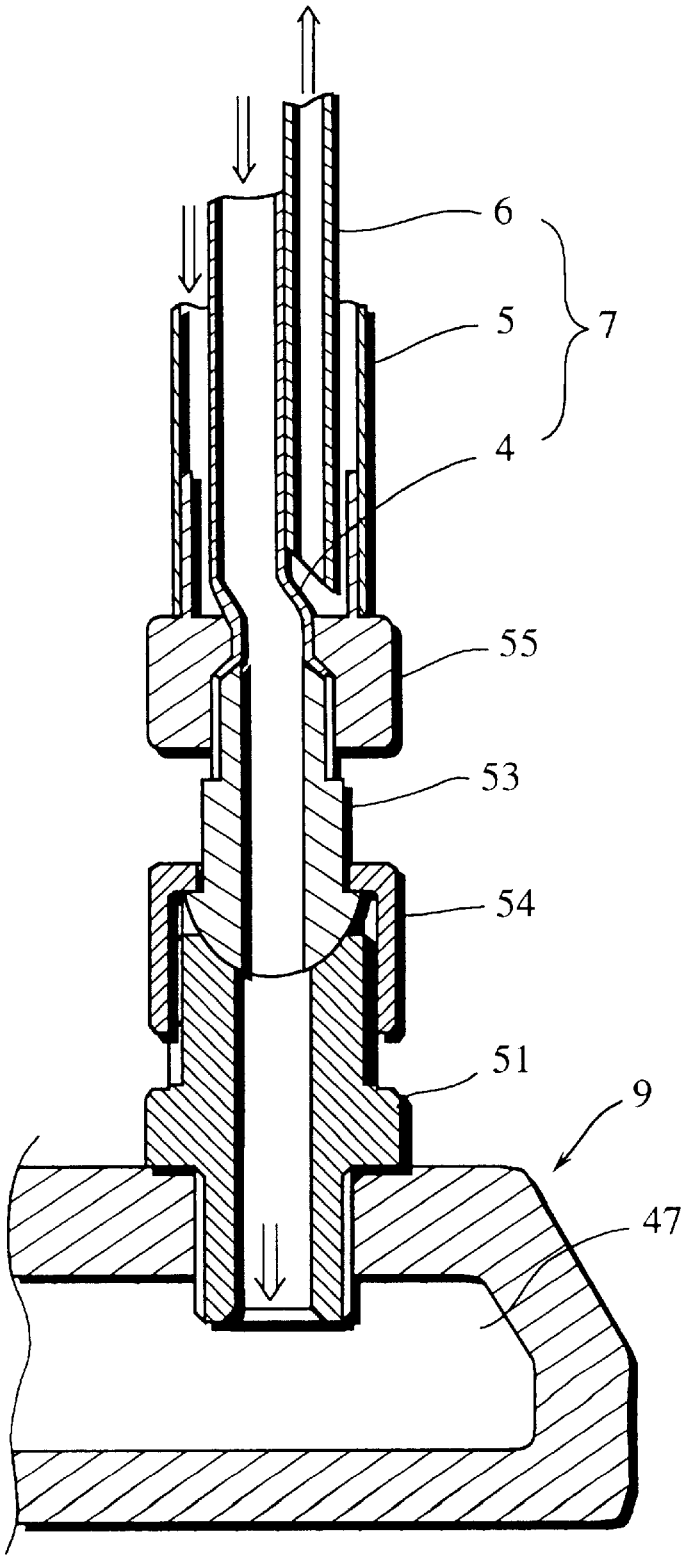
FIG. 6 is an enlarged cross-sectional view of a principal portion of another preferred embodiment of the present invention.

Next, FIG. 5 and FIG. 6 show another embodiment of the iron for business use relating to the present invention, in which a steam reserve chamber 47 and an ironing steam flow chamber 22 are formed in a heating body 9 of an iron main body 1, a first tube 4 for ironing steam is communicatively connected to the steam reserve chamber 47 through a connecting portion 24, and the steam reserve chamber 47 is communicatively connected to the ironing steam flow chamber 22 through a short pipe 48 standing on an upper face portion of a two-staged inner bottom face of the steam reserve chamber 47. A tapped hole 49 goes through an upper wall forming an upper face of the steam reserve chamber 41 of the heating body 9, and a lid 50 with a male screw portion is screwed into the tapped hole 49 as to lid the tapped hole 49. And, a heater 52 heating walls around the steam reserve chamber 41 is embedded in the heating body 9. This heater 52 is electrically connected to a temperature-control means not shown in Figures.

And, the connecting portion 24 is provided with a connection member 51 fixed to a rear portion of the upper face side of the heating body 9 as to communicate with the steam reserve chamber 41, a short connecting pipe 53 communicatively connecting the connection member 51 to the first tube 4, and a connection member 54 connecting the short connecting pipe 53 to the connection member 51. And, a return cap 55, for returning the steam from an end of the second tube 5 to an end of the third tube 6, and for coupling of the first tube 4 and the short coupling pipe 53, is attached to an end portion of a downstream side of a flexible connection tube 7. Other parts of the construction are similar to that shown in FIG. 1 through FIG. 4.

Therefore, according to this iron for business use, (regardless of steam blowout from the steam jets 10) the heating body 9 is heated by the electrified heater 52 of the iron main body 1 during the operation, and steam continuously fills the steam reserve chamber 47 thereby. And then, when the grip switch 12 is switched-on, an electromagnetic valve not shown in FIGS. 5 and 6 opens, steam flows into the first tube 4, and the steam in the steam reserve chamber 47 is immediately blown out of the steam jets 10 through the steam flow chamber 22 by the pressure of the steam flow from the first tube 4. And, it is unnecessary to set other members such as a sole onto the heating body 9 in case of low-temperature ironing, because the heating body 9 can be regulated to be a random temperature with the heater 52 and the temperature-control means, and fine workings can be conducted without problems.

Figure 7:
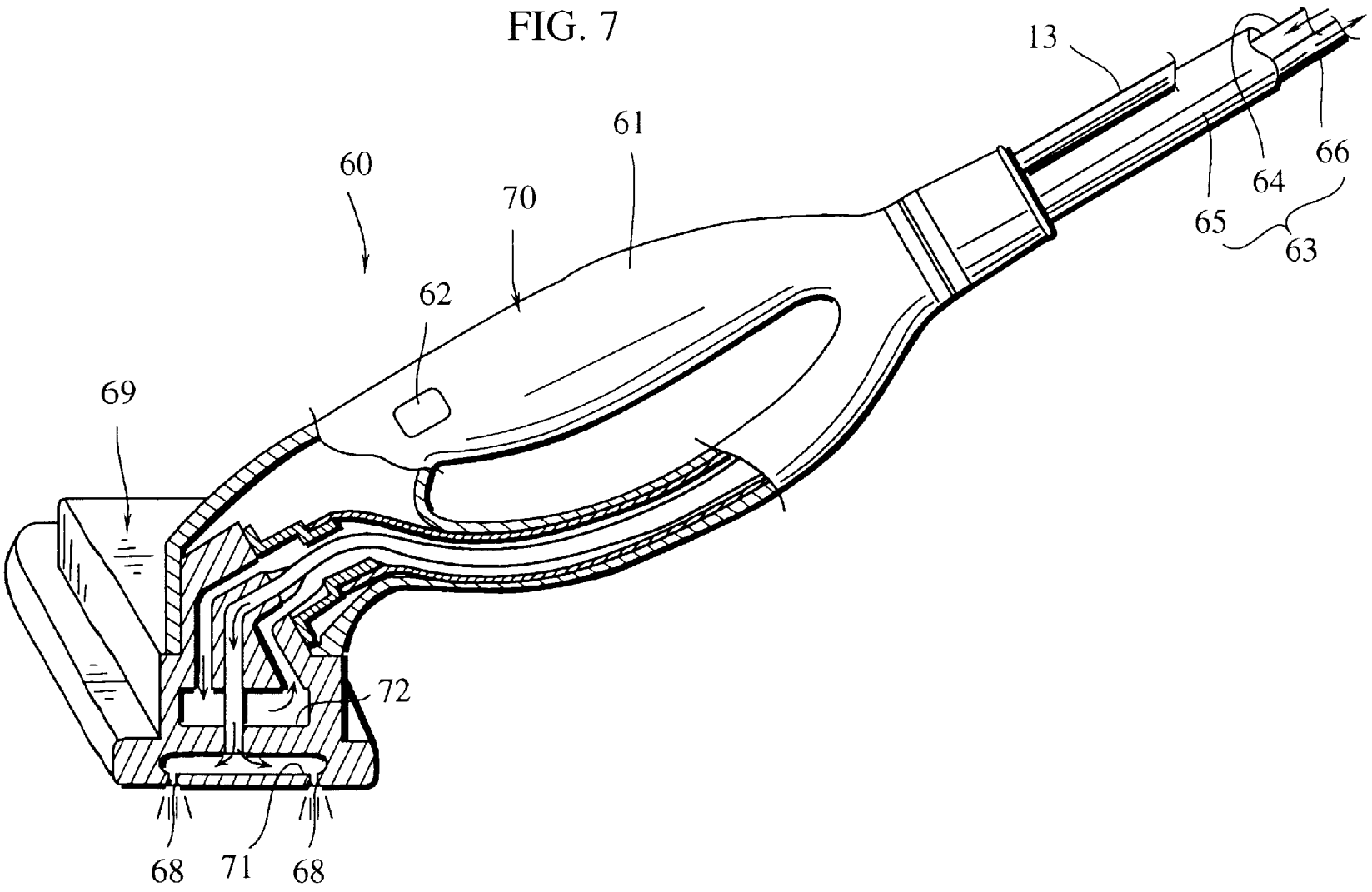
FIG. 7 is a schematic cross-sectional view of a steam brush relating to the present invention.

Next, FIG. 7 shows an embodiment of a steam brush for business use relating to the present invention. This steam brush, which is for removing wrinkles on clothes (costumes) just taken out from clothes press, etc. in department stores, clothing wholesalers' shops, wedding halls, etc., has a steam brush main body 60, a connection cord 13 for connecting a grip switch 62 on a grip portion 61 of the steam brush main body 60 to an electromagnetic valve out of FIG. 7 electrically, and a flexible connection tube 63 which sends brushing steam and heating steam to the steam brush main body 60. Further, an electromagnetic valve 73 shown in FIG. 4, which controls flow and stop of the brushing steam, is arranged on an upstream side of the flexible connection tube 63.

The flexible connection tube 63 is provided with a first tube for brushing steam 64, a second tube 65 for heating steam which sends the heating steam to its end side along the first tube 64 and heats approximately full length of the first tube 64, and a third tube (return tube) 66 which returns the steam from the end side of the second tube 65.

In further-detailed description, as shown in a cross-section of FIG. 3, the flexible connection tube 63 has a triple-tube structure in which the first tube 64 and the third tube 66 are inserted into the second tube 65. And, two gaps between an inner face of the second tube 65 and outer faces of the first tube 64 and the third tube 66 are heating steam passages 67.

Returning to FIG. 7, the steam brush main body 60 is provided with a heating body 69 of which lower face has the plural steam jets 68, and a cover 70 which is having the grip portion 61 provided with the grip switch 62 and attached to the heating body 69. The heating body 69 has a brushing steam flow chamber 71 and a heating steam chamber 72, which is formed separately from the brushing steam flow chamber 71, to which the second tube 65 and the third tube 66 are communicatively connected, and in which the heating steam continuously flows. And, inner end portions of the steam jets 10 are communicatively connected to the brushing steam flow chamber 71.

And, as shown in FIG. 4, a heating steam flow passage 20, in which the heating steam to the second tube 65 continuously flows, is formed in the electromagnetic valve 73. Further, the second tube 65 and a second steam outflow passage 36 are communicatively connected by connecting the second tube 65 of the flexible connection tube 63 to a cylindrical member for connection 45, the first tube 64 is communicatively connected to a first steam outflow passage 35, and the third tube 66 is communicatively connected to a return steam passage 37.

By the construction as described above, time lag between the switching-on and the steam blowout is very little because the electromagnetic valve 73, the first tube 64, and the heating body 69 of the steam brush main body 60 are continuously heated by the heating steam, and the steam can be blown out of the steam jets 68 right after the grip switch 62 is on. And, blowing the water drops out of the steam jets 68 can be prevented, clothes do not wet, and steam-brushing operation can be conducted quickly and cleanly thereby.

According to the iron for business use of the present invention, the first tube 4 for ironing steam is filled with steam during the operation, and water droplets are not generated. Therefore, responsiveness of the steam blowout to the switching-on becomes good. That is to say, the period of time between the switching-on and the steam blowout becomes remarkably short. Therefore, ironing operation can be conducted efficiently. And, blowout of water droplets can be prevented when the steam is blown, clothes do not wet, and ironing operation can be conducted quickly and cleanly.

And, the first tube 4, the second tube 5, and the third tube 6 do not separate, and the first tube 4 is heated certainly and efficiently.

Further, according to the iron for business use of the present invention, it is possible to continuously heat the electromagnetic valve 3 itself, and this makes the responsiveness of the steam blowout to the switching-on better.

And, an electric heater is unnecessary, since the iron main body 1 can be continuously heated by use of the heating steam. Moreover, the ironing steam does not condense into water droplets, and blowout of the water droplets can be prevented more certainly.

According to the steam brush for business use of the present invention, the first tube 64 for brushing steam is filled with steam during the operation, and water droplets are not generated. Therefore, responsiveness of the steam blowout to the switching-on becomes good. That is to say, the period of time between the switching-on and the steam blowout becomes remarkably short. Therefore, steam-brushing operation can be conducted efficiently. And, blowout of water droplets can be prevented when the steam is blown, clothes do not wet, and brushing operation can be conducted quickly and cleanly.

And, the first tube 64, the second tube 65, and the third tube 66 do not separate, and the first tube 64 can be heated certainly and efficiently.

Further, according to the steam brush for business use of the present invention, it is possible to continuously heat the electromagnetic valve 73 itself, and this makes the responsiveness of the steam blowout to the switching-on better.

And, an electric heater is unnecessary, since the steam brush main body 60 can be continuously heated by use of the heating steam. Moreover, the brushing steam does not condense into water droplets, and blowout of the water droplets can be prevented more certainly.

While preferred embodiments of the present invention have been described in this specification, it is to be understood that the invention is illustrative and not restrictive, because various changes are possible within the spirit and indispensable features.

What is claimed is:

1. An iron for business use comprising:

an iron main body;

an electromagnetic valve controlling flow and stop of ironing steam;

a first tube for ironing steam sending the ironing steam to the iron main body in an open state of the electromagnetic valve;

a second tube for heating steam sending heating steam to its end side along the first tube, and heating approximately whole length of the first tube; and a third tube returning the steam from the end side of the second tube.

2. The iron for business use as set forth in claim 1, wherein the first tube and the third tube are inserted into the second tube.

3. The iron for business use as set forth in claim 1 or claim 2, wherein a heating steam flow passage, in which the heating steam to the second tube continuously flows, is formed in the electromagnetic valve.

4. The iron for business use as set forth in claim 1 or claim 2, wherein a heating steam chamber, which is communicatively connected to the second tube and the third tube, and in which the heating steam continuously flows, is formed in the iron main body.

5. The iron for business use as set forth in claim 1 or claim 2, wherein a heating steam chamber, which is communicatively connected to the second tube and the third tube, and in which the heating steam continuously flows, is formed in the iron main body, and, a heating steam flow passage, in which the heating steam to the second tube continuously flows, is formed in the electromagnetic valve.

6. A steam brush for business use comprising:

a steam brush main body;

an electromagnetic valve controlling flow and stop of brushing steam;

a first tube for brushing steam sending the brushing steam to the steam brush main body in an open state of the electromagnetic valve;

a second tube for heating steam sending heating steam to its end side along the first tube, and heating approximately whole length of the first tube; and a third tube returning the steam from the end side of the second tube.

7. The steam brush for business use as set forth in claim 6, wherein the first tube and the third tube are inserted into the second tube.

8. The steam brush for business use as set forth in claim 6 or claim 7, wherein a heating steam flow passage, in which the heating steam to the second tube continuously flows, is formed in the electromagnetic valve.

9. The steam brush for business use as set forth in claim 6 or claim 7, wherein a heating steam chamber, which is communicatively connected to the second tube and the third tube, and in which the heating steam continuously flows, is formed in the steam brush main body.

10. The steam brush for business use as set forth in claim 6 or claim 7, wherein a heating steam chamber, which is communicatively connected to the second tube and the third tube, and in which the heating steam continuously flows, is formed in the steam brush main body, and, a heating steam flow passage, in which the heating steam to the second tube continuously flows, is formed in the electromagnetic valve.

* * * * *